United States Patent [19]

McKinney

[11] Patent Number: 4,694,998

[45] Date of Patent: Sep. 22, 1987

[54] VACUUM ASSEMBLY FOR WIRE UNWRAPPER

[75] Inventor: Donald L. McKinney, Kent, Wash.

[73] Assignee: The Boeing Company, Seattle, Wash.

[21] Appl. No.: 780,174

[22] Filed: Sep. 26, 1985

[51] Int. Cl.[4] ..... B65H 81/00

[52] U.S. Cl. ..... 242/1; 29/765; 29/DIG. 84; 7/107

[58] Field of Search ..... 242/7.06, 7.17, 7.18, 242/1; 140/93 A, 93.2, 124; 29/DIG. 84, 764; 175/209, 213; 173/75; 408/56, 58; 51/273; 7/107

[56] References Cited

U.S. PATENT DOCUMENTS

| | | | |
|---|---|---|---|
| 2,107,864 | 2/1938 | Hunter | 175/209 |
| 2,183,262 | 12/1939 | Kelley | 175/209 |
| 3,019,517 | 2/1962 | Lovecky | 242/7.17 |
| 4,209,069 | 6/1980 | Smith | 175/209 |
| 4,250,971 | 2/1981 | Reibetanz et al. | 175/209 |
| 4,519,552 | 5/1985 | Tucker | 242/217 |

*Primary Examiner*—Billy S. Taylor
*Attorney, Agent, or Firm*—Seed & Berry

[57] ABSTRACT

A vacuum assembly for unwrapping electrical wire from an electrical post of a logic panel and preventing the loss of broken wire on the panel. The assembly having a housing surrounding a wire wrap removal tool and drawing a vacuum therearound when the end of the removal tool engages and unwraps the wire from the post.

7 Claims, 4 Drawing Figures

VACUUM ASSEMBLY FOR WIRE UNWRAPPER

BACKGROUND OF THE INVENTION

This invention relates to the wrapping and unwrapping of wire around an electrical post and more particularly, but not by way of limitation, to a vacuum assembly for drawing a vacuum around a wire wrap removal tool when unwrapping the wire from an electrical post on a logic panel.

Heretofore, logic panels have been shorted out due to broken pieces of wire wrap. This occurs during the removal and unwrapping of leads wrapped around electrical posts on a logic panel. At this time, quite often, very small pieces of wire tend to break and fall into the logic unit. At the present time, there is no apparatus or method to catch and prevent these pieces of wire from falling into the logic panel during the unwrapping operation.

The present method of removing small broken pieces of wire from a logic panel after the panel has been reworked is by attaching the unit to a conventional vibrator or similar equipment. The assembly is vibrated above a sheet of plastic to catch any of the small pieces which are vibrated loose from the panel. This method is not completely effective and once a piece of broken wire has fallen into the maze of wiring, there is no guarantee the wire will ever be removed let alone found. Also, the removal of pieces of wire by vibration could cause serious damage to the electrical components on the panel.

In the following United States Patents; U.S. Pat. No. 2,463,455, U.S. Pat. No. 2,349,156, U.S. Pat. No. 3,850,254, U.S. Pat. No. 3,880,047, U.S. Pat. No. 4,036,308, U.S. Pat. No. 4,192,104, U.S. Pat. No. 4,209,069; U.S. Pat. No. 4,361,957 various types of wire wrapping equipment and vacuum tools are disclosed. None of the above-mentioned patents provide the unique features and advantages of the vacuum assembly for preventing the loss of broken wire in a logic panel.

SUMMARY OF THE INVENTION

The subject invention helps eliminate the possibility of electrical shorts and intermittente due to broken wire falling into a logic panel. The subject assembly is designed for holding a wire wrap removal tool therein and vacuuming any broken pieces of wire during the wire unwrapping operation.

The subject assembly can be used in various electronic assembly operations for both wrapping and unwrapping wire from logic panels and similar circuitry boards and panels.

The vacuum assembly for unwrapping wire from an electrical post is simple in design, readily adaptable for receiving a wire wrap removal tool therein. Further, the assembly can be made of various types of metals, plastics and similar materials.

The vacuum tool assembly for unwrapping wire from an electrical post using a wire wrap removal tool includes a hollow housing for receiving the removal tool therein. A tool turning knob is rotatably attached to the top of the housing and includes a socket for receiving one end of the wire wrap removal tool therein and for turning the removal tool inside the housing. A vacuum line is connected through a hollow handle attached to the side of the housing for drawing a vacuum inside the housing and around the wire wrap removal tool when it is removing wire from an electrical post of a logic panel.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
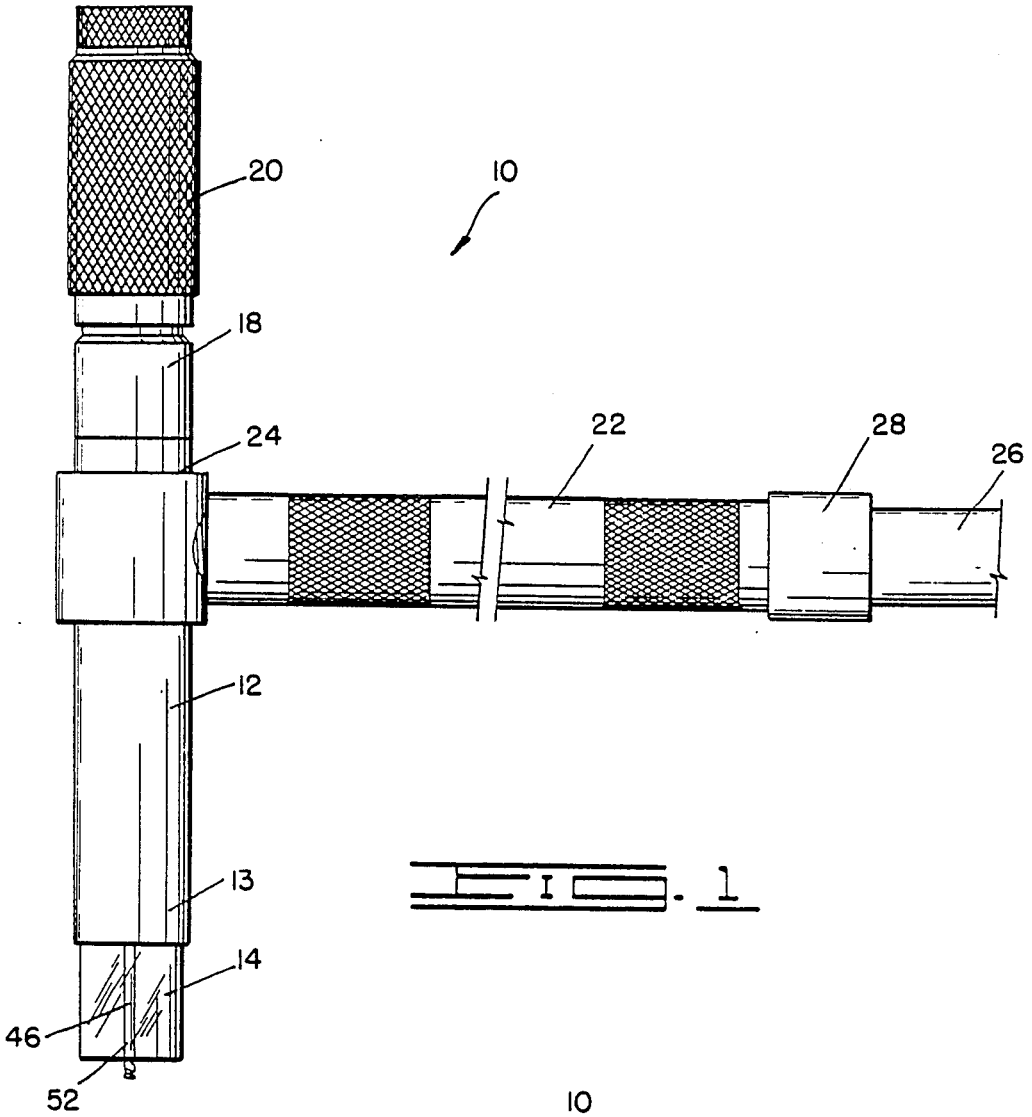
FIG. 1 is a side view of the vacuum assembly with a wire wrap removal tool received therein.
Figure 4:
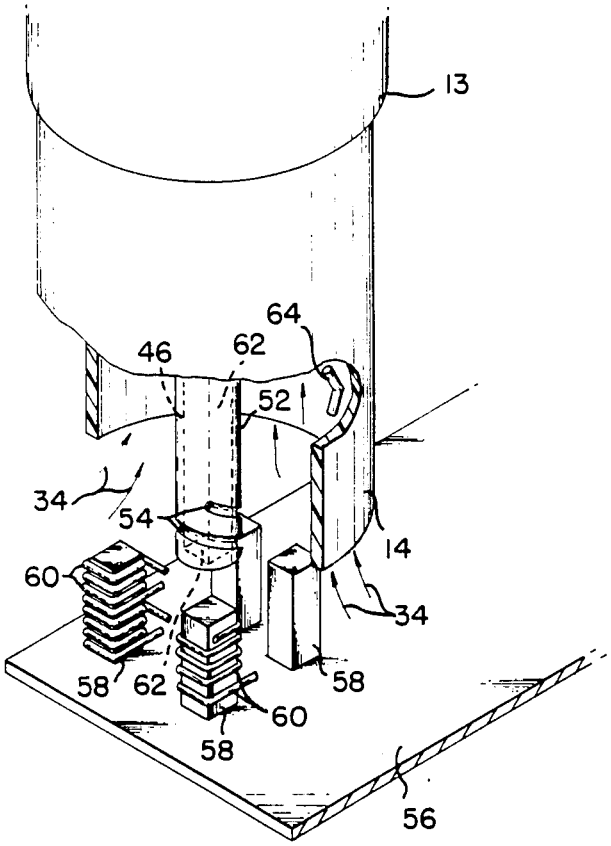
FIG. 4 is an enlarged view of a portion of a logic panel with electrical posts and a portion of the flexible end of the vacuum assembly housing.

In FIG. 1 the vacuum assembly for unwrapping electrical wire from an electrical post of a logic panel is shown and given general reference numeral 10. The assembly 10 includes a hollow housing 12 having one end 13 with a flexible end portion 14. The end portion 14 may be made of a pliable plastic material or any other similar material for providing flexibility and a cover when it is received around a plurality of upright electrical posts as shown in FIG. 4. The assembly 10 further includes a second end 18. A tool turning knob 20 is rotatably attached to the top of the second end 18.

The assembly 10 further includes a hollow handle 22 attached to a side 24 of the housing 12 and communicating therewith. A vacuum line 26 is connected to the other end of the hollow handle 22 through the use of a connector 28.

Figure 2:
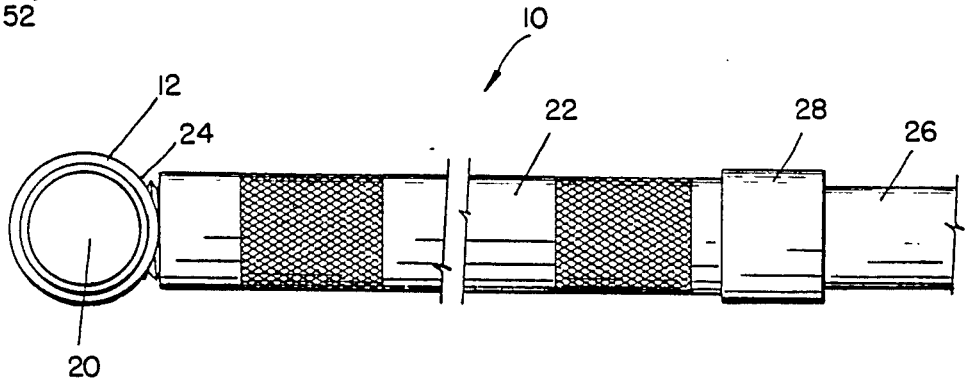
FIG. 2 is a top view of the vacuum assembly.

In FIG. 2 a top view of the assembly 10 can be seen with the hollow handle 22 attached to the side 24 of the hollow housing 12.

Figure 3:
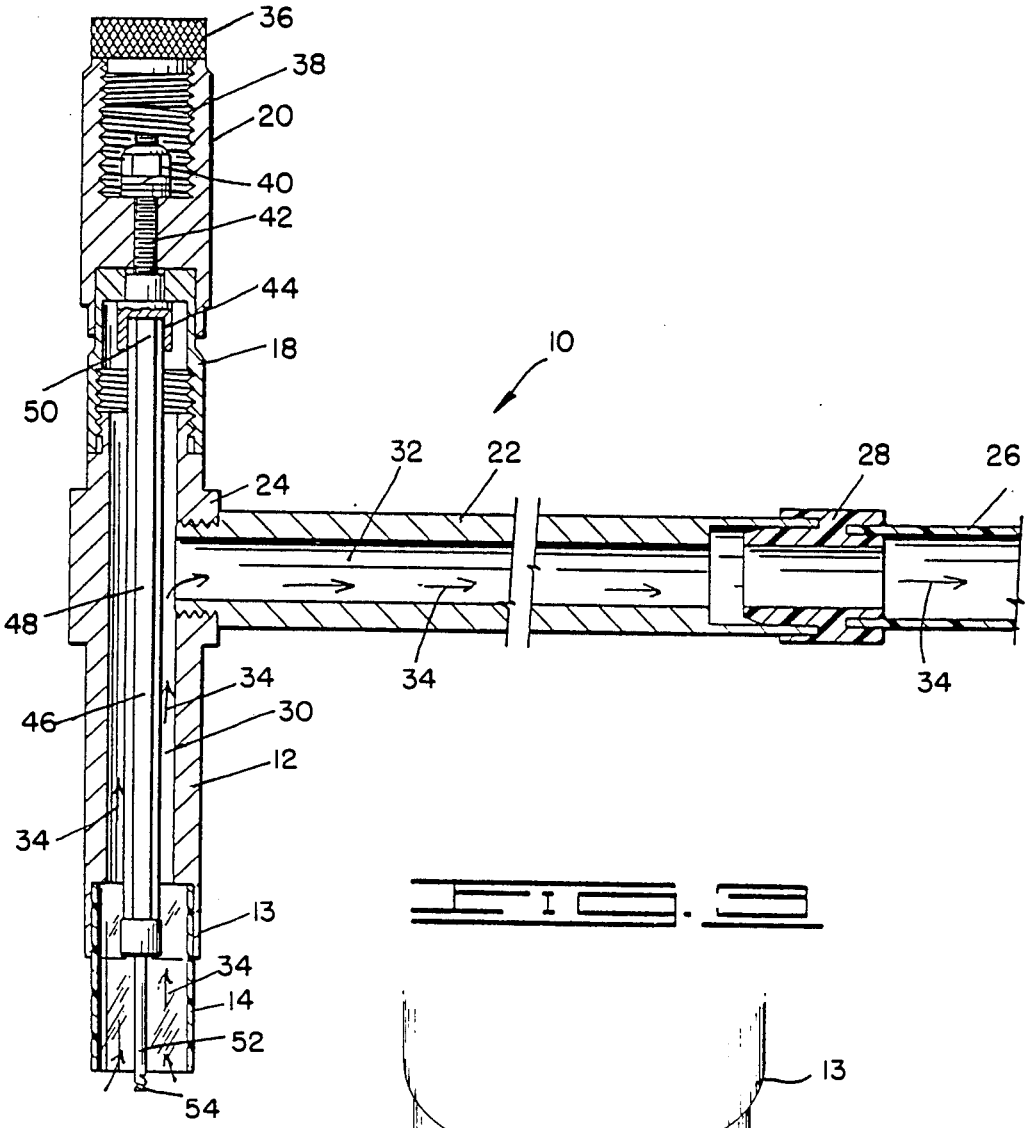
FIG. 3 is a side-sectional view of the vacuum assembly.

In FIG. 3 a side-sectional view of the vacuum system 10 is shown. In this view, the housing 12 and hollow handle 22 can be seen with openings 30 and 32 therethrough for receiving a a vacuum from vacuum line 26. The vacuum is indicated by arrows 34.

In this view the tool turning knob 20 can be seen having a threaded cap 36 attached to a threaded bore 38. The bore 38 receives a nut 40 secured to one end of a threaded screw 42 having a socket 44 attached thereto. In this view, a wire wrap removal tool 46 can be seen having an elongated hexangle body 48 with an upper end portion 50 received in the socket 44 in a press fit. By rotating the tool turning knob 20 on top of the second end 18 of the hollow housing 12, the wire wrap removal tool 46 is turned therein. The lower end of the wire wrap removal tool 46 includes a metal pin 52 having spiral grooves 54. The grooves 54 are used for engaging a portion of the wrapped wire and removing the wire from an electrical post.

In FIG. 4 a portion of a logic panel 56 is shown having a plurality of electrical upright posts 58 having electrical wire 60 wrapped therearound. The posts 58 quite often will have up to three or more different wires wrapped thereon with five wrapped turns. When it is desired to unwrap the electrical wire 60 from the post 58 when rewiring the panel 56, the flexible end portion 14 is lowered around a number of the electrical posts with the pin 52 of the wire wrap removal tool 46 lowered over the top of the chosen electrical post 58.

Shown in dotted lines in FIG. 4 is an angular opening 62 in the pin 52 which is used to receive the electrical post 58 therein. When this occurs, the upper portion of the electrical wire 60 is received in the spiral groove 54 and as the wire wrap removal tool 46 is turned by rotating the tool turning knob 20, the wire 60 is removed from the post 58.

It should be noted while the assembly 10 is described primarily for use with the wire wrap removal tool 46, it could be adapted for a wire wrapping tool or any similar type of tool used for wrapping and unwrapping electrical wire on logic panels and the like. During the operation of wrapping electrical wire around the electrical post 58, wire is wrapped tightly, normally with four or five wraps therearound. When tightly wrapping the wires, quite often, a break in the side of the wire may occur where it contacts the corner edge of the upright post 58. Therefore, when the wire 60 is removed, small portions of the electrical wire may break and heretofore fall into the maze of electrical wiring on the logic panel 56. But, through the use of vacuum assembly 10, small pieces of wire such as wire having numeral 64 shown in FIG. 4 are quickly removed by the vacuum drawn around the electrical post 58 during the wire wrap removal operation.

Changes may be made in the construction and arrangement of the parts or elements of the embodiments as described herein without departing from the spirit or scope of the invention defined in the following claims.

What is claimed is:

1. A vacuum assembly for vacuuming around an electrical post while unwrapping wire from the electrical post with a wire wrap removal tool, the tool having two ends, a first end being adapted for engaging the wire wrapped around the electrical post, the vacuum assembly comprising:

a hollow housing for receiving the removal tool therein;

tool connecting means for connecting the second end of the removal tool inside the housing and rotating the removal tool therein in order to unwrap the wire from the electrical post; and vacuum means communicating with the housing for drawing a vacuum in the housing and in the vicinity of the tool as the tool unwraps the wire.

2. The assembly as described in claim 1 wherein the housing has a flexible end portion adjacent the first end of the removal tool.

3. The assembly as described in claim 1 wherein the tool connecting means is a tool turning knob rotatably attached at one end of the housing, the knob connected to the second end of the removal tool.

4. The assembly as described in claim 1 further including a handle attached to the side of the housing for holding the assembly when unwrapping wire with the wire wrap removal tool.

5. A vacuum assembly for vacuuming around an electrical post while unwrapping wire from the electrical post with a wire wrap removal tool, the tool having two ends, a first end adapted for engaging the wire wrapped around the electrical post, the vacuum assembly comprising:

a hollow housing for receiving the removal tool therein, one end of the housing being flexible for receipt around one or more electrical posts when the first end of the removal tool engages the wire, the second end of the removal tool being rotatably attached inside the other end of the housing using a tool connecting means for rotating the removal tool therein in order to unwrap the wire from the electrical post; and vacuum means communicating with the housing for drawing a vacuum in the housing and around the tool as the tool unwraps the wire.

6. The assembly as described in claim 5 wherein the tool connecting means is a tool turning knob rotatably attached to the housing, the knob connected to a socket for receiving an end of the removal tool therein in a press fit.

7. The assembly as described in claim 5 further including a hollow handle, one end of the handle attached to and communicating with the hollow housing, the other end of the hollow handle connected to the vacuum means for drawing a vacuum in the housing and around the tool as the tool unwraps the wire.

* * * * *